US005630201A

United States Patent [19]

Suzuki et al.

[11] Patent Number: 5,630,201

[45] Date of Patent: May 13, 1997

[54] DEVELOPMENT APPARATUS HAVING A PLURALITY OF ROLLS ROTATED AT PARTICULAR SPEEDS

[75] Inventors: Katsuhiko Suzuki; Takao Umeda, both of Mito; Masayasu Anzai, Hitachi, all of Japan

[73] Assignee: Hitachi Koki Co., Ltd., Tokyo, Japan

[21] Appl. No.: 607,094

[22] Filed: Feb. 28, 1996

[30] Foreign Application Priority Data

Mar. 10, 1995 [JP] Japan ..... 7-050857
Apr. 14, 1995 [JP] Japan ..... 7-089240

[51] Int. Cl.[6] ..... G03G 15/09

[52] U.S. Cl. ..... 399/269

[58] Field of Search ..... 355/251, 253; 118/657, 658

[56] References Cited

U.S. PATENT DOCUMENTS

| | | | |
|---|---|---|---|
| 3,908,595 | 9/1975 | Okada | 118/658 |
| 4,095,883 | 6/1978 | Parker et al. | 355/253 |
| 5,416,571 | 5/1995 | Yamada et al. | 355/251 |
| 5,516,982 | 5/1996 | Takeuchi et al. | 355/251 X |

FOREIGN PATENT DOCUMENTS 62-2313 1/1987 Japan .

*Primary Examiner*—Nestor R. Ramirez
*Attorney, Agent, or Firm*—Bardehle, Pagenberg, Dost, Altenburg, Frohwitter, Geissler & Partners

[57] ABSTRACT

The present invention provides a development apparatus capable of improving the development pole of a plurality of development rolls and the rotation speed thereof, thus obtaining stable printing quality. A first development roll rotatable in the opposite direction to the moving direction of photosensitive body is disposed in the upstream of it, whereas a group of second development rolls are disposed in the down stream, which development rolls are rotatable in the same direction as the moving direction of photoconductive body and have magnets of the same polarity. The first development roll and the photoconductive body define a peripheral speed ratio ranging from 0.5 to 1.5, while allowing the second development roll and the photoconductive body to define a peripheral speed ratio ranging from 0.6 to 1.5. A development control member is provided between the first development roll and the group of second development rolls. A toner density detector is provided in the downstream of the last one of the group of second development rolls which is disposed in the most significant downstream. A cross mixer and a carrier member are also provided under the first development roll and the group of second development rolls.

14 Claims, 6 Drawing Sheets

DEVELOPMENT APPARATUS HAVING A PLURALITY OF ROLLS ROTATED AT PARTICULAR SPEEDS

BACKGROUND OF THE INVENTION

1. Field of the Invention

The present invention relates generally to development machines for use in electronic image-forming or photographing systems.

2. Description of the Related Art

A conventional development machine or apparatus has been described, for example, in Japanese Patent Publication Number 62-2313, wherein two development rolls are disposed in such a manner that they may rotate in the same direction as the moving direction of a photosensitive body. With the prior art apparatus, two poles of the same polarity are disposed at the development pole of either one of such development rolls. The apparatus is arranged such that the rotation speed of a first development roll provided in the upstream is greater than the moving speed of the photosensitive body, while that of a second development roll is less than the same.

Disadvantages faced with the prior art development apparatus are as follows:

(a) Drum lock may possible take place by a developer due to the fact that the moving speed of such development rolls moving in the same direction is greater on the upstream side and yet less on the downstream side.

(b) The image density may decrease as the printing speed increases.

(c) The development roll(s) and/or the rotation shaft of a carrier roll may be abraded or locked mechanically.

SUMMARY OF THE INVENTION

It is therefore an object of the present invention to provide a development apparatus which can avoid the disadvantages of the prior art and can offer stable printing quality.

The foregoing object may be accomplished by providing a development apparatus for effecting the magnetic brush phenomenon by supplying a developer to an opposed photoconductive body with photoconductivity by use of a plurality of nearby development rolls with magnetically attractive forces disposed in the vicinity of the photosensitive body, wherein the device includes (i) a first development roll having a unipole development magnet at a development pole contributing to development, and being movable in a direction opposite to the moving direction of the photosensitive body, and (ii) a group of second development rolls including one or more development rolls having a plurality of magnetically attractive nearby forces and causing a plurality of magnets of the same polarity at a development pole contributing to development, featured in that the first development roll is disposed in the upstream of the moving direction of the photosensitive body, that the second development rolls are disposed in the downstream of the moving direction of the photosensitive body, and that the first development roll and the photosensitive body are arranged to define a specific peripheral speed ratio which ranges from 0.5 to 1.5, while allowing the second development rolls and the photosensitive body to define a peripheral speed ratio ranging from 0.6 to 1.5.

In accordance with the development apparatus constructed as described above, the cleaning ability on the photosensitive body may be maintained by the first development roll being rotatable in the opposite direction to the moving direction of the photoconductive body. Further, due to the fact that the developer can be fed smoothly to the photoconductive body by use of the magnets of the same polarity provided at the development poles of the group of second development rolls causing the toner supply amount to increase, the load to the photoconductive body can be decreased to thereby enable, even in case of high speed printing, the resultant image to be kept higher in density and enhanced in quality to thereby offer stable image quality for an increased length of time.

These and other objects, features and advantages of the invention will be apparent from the following more particular description of preferred embodiments of the invention, as illustrated in the accompanying drawings.

DETAILED DESCRIPTION OF PREFERRED EMBODIMENTS

Figure 1:
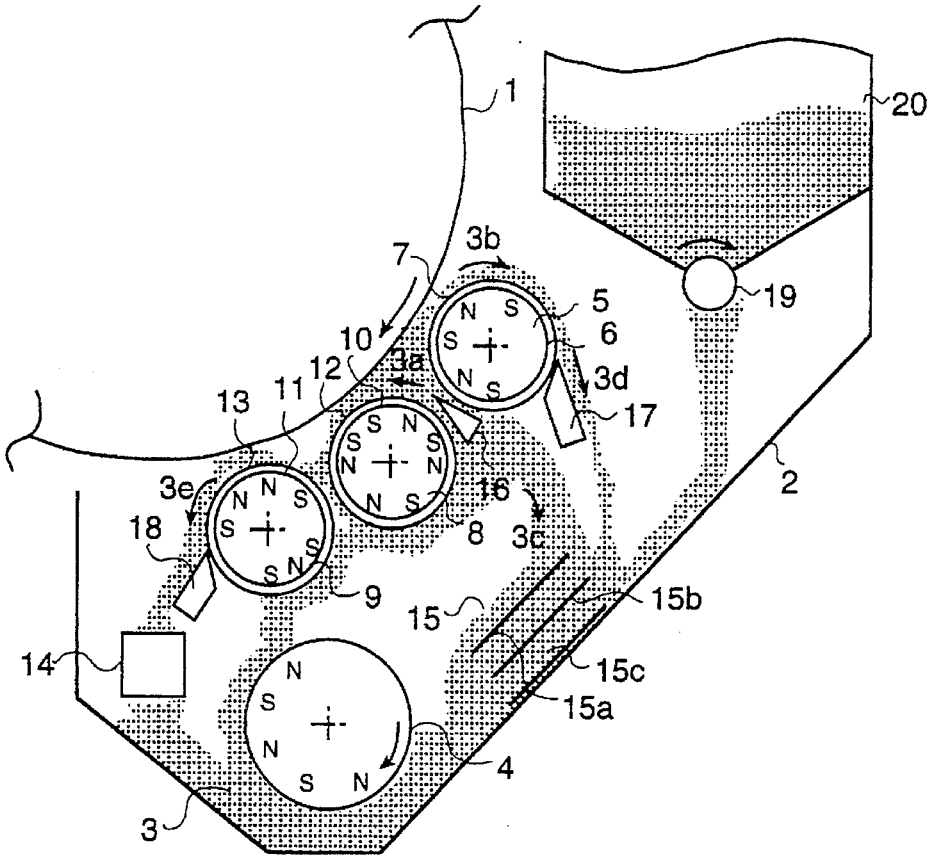
FIG. 1 is a diagram schematically showing a development apparatus in accordance with one preferred embodiment of the present invention.
Figure 2:
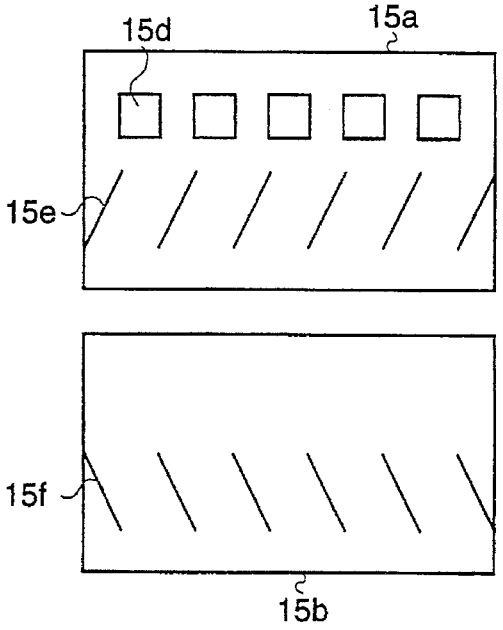
FIG. 2 is an explanatory diagram showing a configuration of a cross mixer.
Figure 3:
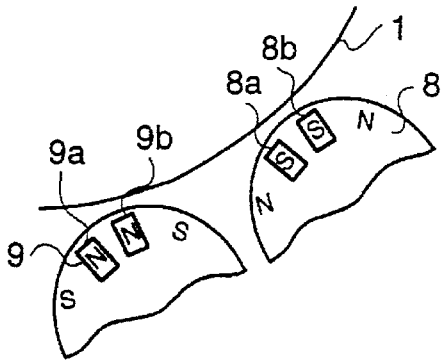
FIG. 3 is a diagram illustrating a configuration of a group of second development rolls.

Referring to FIG. 1, a development machine in accordance with one preferred embodiment of the instant invention is illustrated in cross-section. Note that FIG. 2 shows the configuration of a cross mixer used, whereas FIG. 3 is a cross-sectional view of the major part of a group of development rolls, which will be referred to as the "second development rolls" later in the description.

The development machine includes a drum-shaped photosensitive body 1 with certain photoconductivity, which is rotatable at a selected peripheral speed that may range from 600 to 1800 mm/s. The photosensitive body 1 has a photosensitive layer of a thickness of 50 to 80 μm, which may be made from a chosen photosensing material such as SeTe, SeTeAs, $As_2Se_3$ or the like. The photosensitive body 1 measures 200 to 300 mm in diameter. A group of development rolls, i.e., two development rolls 8 and 9 are disposed in the downstream relative to the moving direction of the photoconductive body 1 in such a manner that they oppose the photoconductive body 1 with a gap defined between this body 1 and themselves falling within a range from 0.6 to 2.0 mm, preferably 0.8 to 1.5 mm, and are rotatable in the same direction as the photoconductive body 1. These development rolls have a plurality of magnetic rolls 8*a*, 8*b*, 9*a*, 9*b* that are same in polarity as the development pole. Another development roll 5 is disposed in the upstream of the development roll group 8, 9 such that the roll 5 is rotatable in the opposite direction to the photoconductive body 1. Note that in the description, this roll 5 will be referred to as the first development roll, whereas the two rolls 8, 9 as the second ones.

A development material or developer 3, which is comprised of a carrier and toner in the bottom of a development vessel 2, is conveyed over the surface of a developer-carrying member 4 rotatably disposed at the bottom of such vessel due to the magnetically attractive force caused by such member 4, and is then transferred onto the surface of one of the second development roll group which is near the developer-carrying member 4, here the second development roll 9. The developer-carrying member 4 may be a magnetic roll that diametrically measures 50 to 120 mm. The developer transferred is adhered on the surface of member 4 due to the presence of magnetically attractive force of the second development roll 9; then, the developer 3 is forced by rotation of a sleeve 13 to move toward the upstream, in the opposite side of a certain side facing the photoconductive body of the second development roll 9, to be transferred to the other of the second development roll group, i.e., the second development roll 8.

The developer 3 now transferred is adhered onto the surface of the second development roll 8 due to its magnetically attractive force; the developer 3 transferred by the rotation of the sleeve 12 is controlled by a developer control member 16 so that it remains constant in amount. Thereafter, a developer 3*a* is carried between the photoconductive body 1 and the second development roll group 8, 9 to become contact with the photoconductive body 1 causing development to be effected.

A developer 3*c* that is out of the control of the developer control member 16 is conveyed on the rear surface of the member 16 toward the upstream and is then adhered to the surface due to the magnetically attractive force caused by the first development roll 5 which is rotating in the reverse direction to the photoconductive body 1. A developer 3*b* that is conveyed by rotation of the sleeve 7 between the first development roll 5 and the developer control member 1 is controlled again by the developer control member 16 so that its amount remains constant. Thereafter, this developer is conveyed between the photoconductive body 1 and the first development roll 5 to be contacted with the photoconductive body 1 thus completing development.

The developer 3*c* escaped from the control of the developer control member 16 drops down at a first stage 15*a* of a cross mixer 15, which is disposed beneath the developer control member 16 for causing developer to move and flow into the right and left directions; a part of the developer 3*c* is further dropped onto a second stage 15*b* as will be described with reference to FIG. 3. Such diversion to the right and left directions at the first and second stages 15*a*, 15*b* allows the developer components to be stirred and mixed together and then returned to the bottom section of the developer-carrying member 4. On the other hand, a developer 3*d* that has travelled around the surface of the first development roll 5 in case where development is completed at this time is swept off by a scraper blade 17 to drop down at a third stage 15*c* of the cross-mixer 15 in such a way that the developer is mixed with the toner this toner is supplied when the toner density of such developer decreases to be returned to the lower section of the developer carrying member 4. More specifically, this cross-mixer is adapted to attain stirring and mixing of developers while forcing a part of developer to divert into the right and left flow paths in parallel with the shaft of development roll, thus causing the toner density to remain uniform in the developer; the three-stage structure may provide preferable results.

As shown in FIG. 2, the first stage 15*a* is provided with drop holes 15*d* for subdividing the flow of dropping developer 3*c* into almost two components to assure that the resulting developer components flow into the first and second stages. In addition, the first stage 15*a* has several slanted fins 15*e* that enables the movement to the left direction, whereas the second stage 15*b* has fins 15*f* for enabling the movement to the right. In this way, it becomes possible, by use of such developer-flow diversion structure for diverting the dropping developer into the right and left directions, to maintain the toner density of developer uniform between the right and left directions. The third stage 15*c* (the lowest section) is structurally arranged such that the developer 3*d* and extra toner being supplied are mixed together to go downward, while they are prevented from diverting into the right and left directions, to reach the developer-carrying member 4 where they are mixed and carried forward. As a consequence, it is possible to suppress or prevent the occurrence of any positional deviations of toner which may possibly take place by the slanted fins when the toner are directly fed to the first and second stages specifically, the phenomenon that the toner is collected by such slanted fins without adequate or complete mixture of the toner with the developer. This assures that any stripes of contamination do no longer take place in the background of papers used. Note here that the developer 3*e* completed in development after being contacted with the second development roll group 8, 9 and the photoconductive body 1 is swept off by the scraper blade 18. A part of such developer 3*e* is then guided to enter a density detector 14, which is for detecting the toner density in the developer. Thereafter, the developer is returned to the lower section of the developer carrier member 4.

It should be noted that the average grain diameter of toner used for the developer 3 may fall within a range of 6 to 12 μm, preferably, 7 to 9 μm. Such decrease in the average toner grain diameter, i.e., miniaturization of toner, can contribute to the achievement of enhanced quality and higher definition for images developed. Carriers may be magnetite carriers or ferrite ones, which are of spherical shape with the average grain diameter of 80 to 130 μm, coated with a chosen resin such as styrene, acrylic resin, silicon or the like, and exhibit saturation magnetization of 50 to 80 emJ/g at 1 kOe. By determining the dynamic electrical resistivity of the developer to range from $10^8$ to $10^{11}$ Ωcm, preferably $10^9$ to $10^{10}$ Ωcm, it has been demonstrated that stable charging performance can be maintained even at higher speed of development, thus enabling higher image quality to be accomplished. Particularly, the use of magnetite carriers of the average grain diameter of 90 to 120 μm can offer several advantageous features in that excellent fluidity, less possibility of carrier attachment to the photoconductive body, and long life time, which features may be suitable for high-speed development. Under such a condition, the life time of such developer was as long as 200 to 1,000 kilopages/kg; in contrast, the life time of a developer employing iron-power carriers was half the former, or less.

It should be also noted that, with the average grain diameter of less than 80 μm, the attachment of carriers to the drum becomes severe; in the case of more than 130 μm, the resulting image became coarser undesirably. When the average toner grain diameter is 10 to 12 μm, the charge amount of toner may be 15 to 35 μC/g, preferably, 20 to 30 μC/g; at the average grain diameter of 7 to 9 μm, the charge amount is 20 to 50 μC/g, preferably 25 to 40 μC/g. Regarding the toner density, when the surface coverage ratio for the toner carriers is 0.3 to 0.6, the toner density can be improved to the extent that the image density remains higher while the external dispersion of toner around the area of a copying machine can be eliminated. For comparison, when the surface coverage ratio is less than 0.3, any required images of acceptable quality cannot be obtained; at the ratio of 0.6 or more, the dispersion of toner and the blooming tend to take place more frequently.

With this embodiment, excellent results have been obtained even when the coverage ratio is greater than the prior art by employing both the plurality of development magnetic-poles and the three-stage cross-mixer structure and by constituting the developer from specific carriers of enhanced fluidity.

It has been found that, when the major roll-bias voltages are specifically determined to meet the condition defined as $$V_{B1} \geqq V_{B2}$$

where $V_{B1}$ is the bias voltage applied to the first development roll 5, and $V_{B2}$ is the bias voltage to the second development roll group 8, 9, then the photoconductive body 1 can be compensated for any decrease in surface voltage with time due to dark attenuation to provide desired images free from the occurrence of contamination in the background of papers used.

It should be recommendable that, as shown in FIG. 1, the rotation direction of the first development roll 5 be opposite in direction to the photoconductive body 1. This can be said because the rotation of the first development roll 5 is preferably opposite in direction to the movement of the photoconductive body in order to increase the cleaning ability and the toner attachment/adhesion amount on the photoconductive body. Further, since it is desirable that this action is performed at the beginning of development operations, the first development roll 5 is recommendably provided in the upstream along the moving direction of such photoconductive body as shown in FIG. 1. To make an intended image on the photoconductive body thereafter, it is desirable for the rotation of first development roll to be same in direction as the photoconductive body; for this reason, the rotation of the second development roll group is same in direction as the motion or rotation of the photoconductive body as shown in FIG. 1, and simultaneously is disposed in the downstream along the moving direction of such photoconductive body, whereby higher cleaning ability and enhanced development performance can become available so that images of high quality can be obtained at increased reliability.

Attention should be directed to the fact that in the case where high-quality images are attained at the photoconductive-body rotation speed of more than 600 mm/s, in particular, more than 800 mm/s, it is required that the rotation speed of the second development roll group be 1.5 to 3 times the rotation speed of the photoconductive body under an assumption that the development pole contributing to the development at the second development roll group. At such extra high rate of rotation, the load to the developer and the photoconductive body may increase causing the life time of each to decrease and/or causing the bearings for the development rolls and development-carrying roll to decrease in life time due to acceleration of mechanical abrasion. Furthermore, the toner dispersion becomes much severe. To eliminate the occurrence of such phenomena, the first development roll is constituted by a unipole to thereby maintain proper cleaning ability; in addition to this, the development pole contributing to the development at the second development roll group is provided with two or more magnetic poles of the same polarity. These same-polarity magnetic poles may be obtained by use of one of the following techniques: (i) forming a groove of rectangular profile, for example, in the center of such magnetic poles, (ii) embedding powerful magnets such as rare-earth magnets as shown in FIG. 3, or (iii) providing an independent block magnet.

It has been well demonstrated that providing two or more magnetic poles of the same polarity causes the developer to be further softened on the development roll being contacted with the surface of photoconductive body. In the embodiment of FIG. 1, two block magnets of the same polarity are employed. With such same-polarity block magnets, the developer attempts to disperse due to the presence of magnetically repulsive force of the magnets in such a way as to be in contact with the photoconductive body for development. In this case, the resulting development time becomes longer as compared with the development using known magnetic brush(es) of unipole; simultaneously, the development efficiency increases due to the fact that the toner-supply ability is enhanced by the disturbance effect of developer at the development pole section.

Consequently, the development rolls can be decreased in number of revolution with the result of the load to the photoconductive body, developer and bearings being decreased. In the case where the arrangement is adapted in a copying machine having the photoconductive-body rotation speed of 1,000 to 1,800 mm/s, the results are as follows: uniform high-density images could be obtained at the rotation speed of the second development roll group which is 0.6 to 1.5 times the rotation speed of photoconductive body; undesirable toner dispersion could be suppressed or eliminated successfully. In particular, excellent results could be demonstrated when the ratio of rotation speed (the peripheral velocity ratio) ranges from 1.05 to 1.5. At the peripheral velocity ratio of 0.95 to 1.05, color irregularity was occurred a little.

On the other hand, stable cleaning effect and the development effect of high quality could be obtained when the rotation speed of the first development roll is 0.5 to 1.5 times the rotation speed of the photoconductive body. While similar effects was obtained when the rotation speed of the first development roll remains lowered to be of 0.5 to 1.0 time the photoconductive-body rotation speed, it is recommendable that the first and second rolls be either rendered uniform in motion or arranged such that the first roll is slower than the second rolls when the development-roll drive mechanism is actually build up.

When one roll 9 of the second development roll group in the downstream along the photoconductive-body rotation direction is less in rotation speed than the other roll 8 of it which is disposed in the upstream of such roll 9, a "puddle" of developer may possibly take place between the second development roll 9 and the photoconductive body 1 causing drum lock to occur. Fortunately, this could be overcome by arranging the second development roll 9 in the downstream of the other second development roll 8 to be greater in rotation speed than the second development roll 8, to thereby facilitate the flow of development to be more smooth, which may lead to inhibition of the occurrence of any puddle of developer and of drum lock. Additionally, in the case where the first and second development rolls are identical in velocity with each other, it will be recommendable that the downstream development gap be widened by a certain degree of 0.1 to 0.3 mm.

Figure 4:
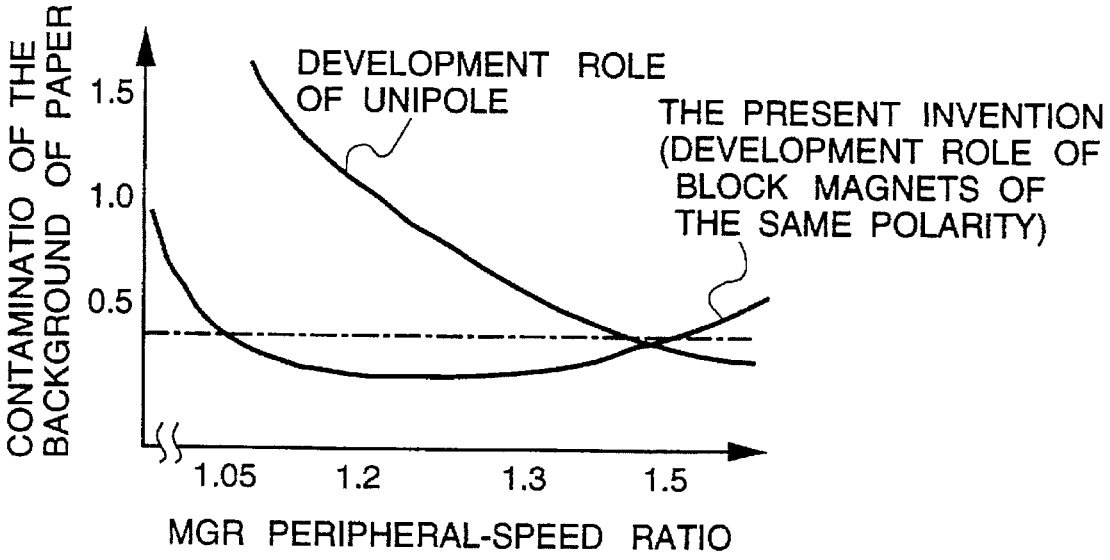
FIG. 4 is a diagram depicting the relation between a peripheral speed ratio of a development roll and contamination occurred in the background of papers used.

Experiments have been done by use of the development apparatus constructed as shown in FIG. 1. The results are shown in FIG. 4, which summarizes experimental data in terms of the occurrence of contamination in the background of papers used in such experiments. Comparing based on the experimental results (i) one case where a unipole was adapted for respective development poles of the second development roll group with (ii) another case where the magnets of the same polarity of the present invention was employed reveals the fact that follows: the occurrence of the paper-background contamination when the same-polarity magnets of the inventions are employed remains less than that in the other case as a whole; this effect becomes more significant when the peripheral velocity ratio is relatively low between the second development roll group and the photoconductive body. From this, it has been found that contamination occurred in the paper background satisfies a specific condition providing an increase in the reflection factor of 0.5% or less when the rotation speed of the second development roll group is 1.05 to 1.5 times the rotation speed of the photoconductive body. Finally, desired images of excellent quality could be obtained by specifically arranging the second development roll group such that the rotation speed thereof is 1.05 to 1.5 times the rotation speed of the photoconductive body, preferably, 1.1 to 1.3 times the same.

Further experiments have also been made by use of the development apparatus of FIG. 1 for investigation regarding the relation of the magnetic-pole angle of magnetic poles of the second development roll group versus the occurrence of contamination in the background of papers used. The results in the case of using development rolls that measure 50 mm in diameter and 30 degrees at same-polarity magnet angle are shown in FIGS. 5 and 6.

Figure 5:
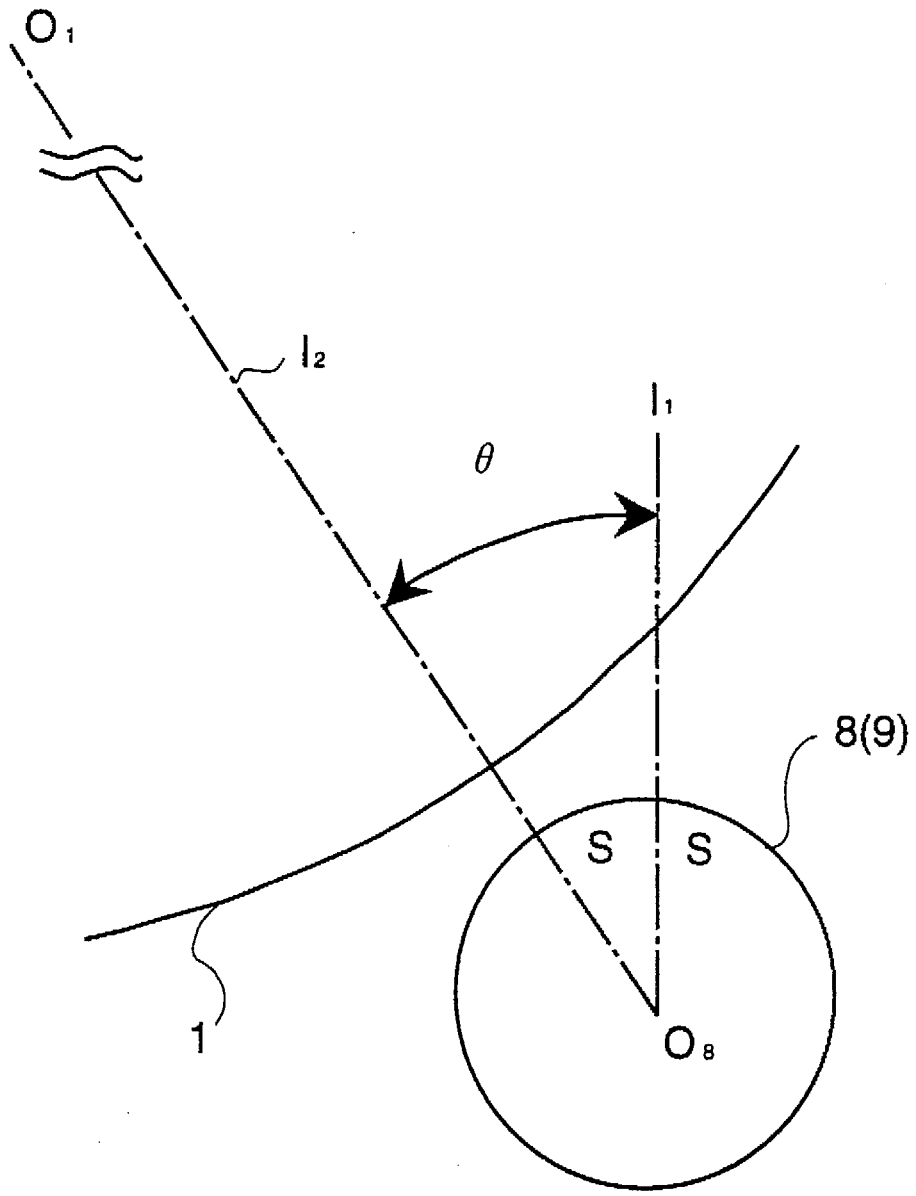
FIG. 5 is a diagram of a magnetic-pole angle.
Figure 6:
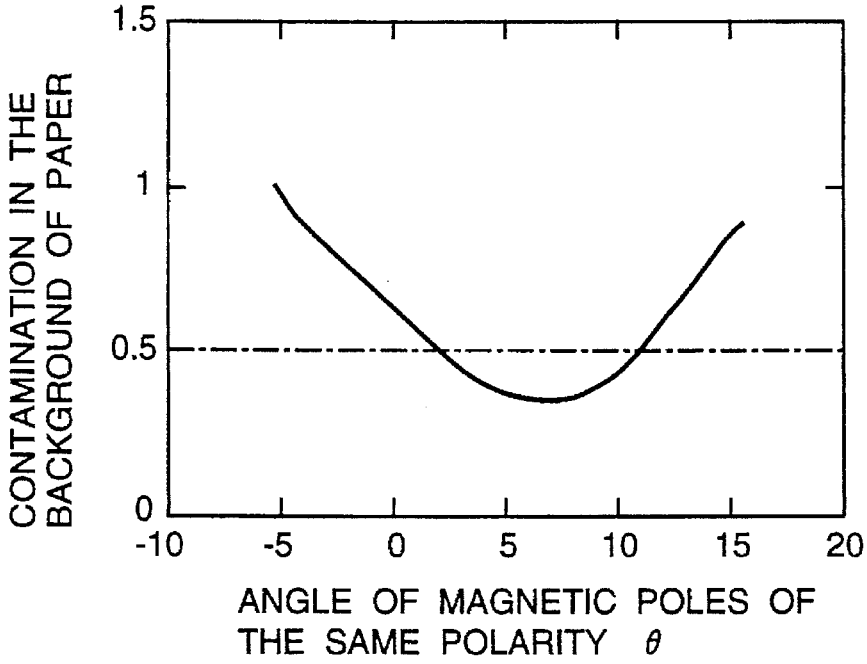
FIG. 6 is a diagram indicating the relation between the magnetic-pole angle and contamination of the background of papers used.

It can be seen from viewing the results of FIGS. 5 and 6 that, when the magnets of the same polarity are adapted for the development poles of the second development roll group, the occurrence of paper-background contamination may decrease to satisfy the condition of the reflectance factor of 0.5% or less, by specifically arranging the magnetic pole angle θ (see FIG. 5) this angle θ is defined between (i) one center line $\lambda_2$ between the same-polarity magnetic poles (S, S) of the development poles of respective development rolls 8, 9 of the second development roll group and (ii) the other center line $O_1$ connecting the center $O_2$ of the photoconductive body and the center $O_2$ of respective development rolls 8, 9 of the second development roll group in such a way that this angle θ is about 5 degrees in the clockwise direction relative to the second development roll group. This assures that images of improved quality could be achieved by arranging the magnetic-pole angle θ of development poles of respective development rolls 8, 9 of the second development roll group to fall in a range from 2.5 to 10.0 degrees in the clockwise direction relative to the second development roll group, preferably 2.5 to 7.5 degrees. The same goes with other cases where the development roll diameter is 40 to 70 mm, and the same-polarity magnet angle is at 15 to 30 degrees. In still other cases where the diameter is 70 to 90 mm and the same-polarity magnet angle is at 15 to 30 degrees, setting of the range to fall within a range of 0 to 7.5 degrees offered good results. Further, an odd number of magnets of the same polarity may be used also; if this is the case, images of improved quality could be provided by setting the magnet angle of the center magnetic-pole between the magnets of the same polarity to fall within a range of 2.5 to 7.5 degrees in the clockwise direction relative to the second development roll group.

Figure 7:
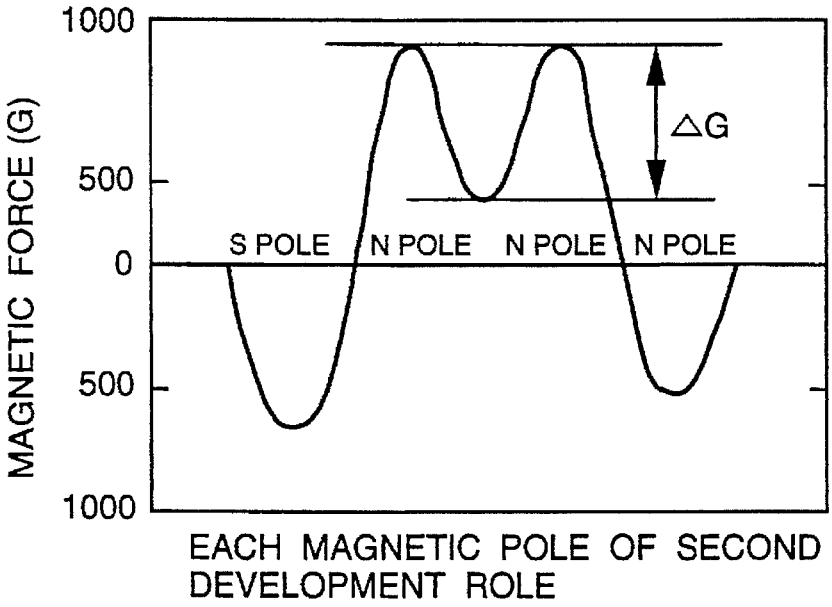
FIG. 7 is a diagram showing the relation of magnetic force versus each magnetic pole of the second development roll.

A further embodiment of the invention will now be described with reference to FIGS. 7 and 8. FIG. 7 shows one available magnetic force curve of the magnets of the same polarity employed for the development poles of the second development roll group. When such magnets of the same polarity are used, the magnetic force drops down in a region between the peak values of respective magnets. It has been actually corroborated that the amount of such drop-down magnetic force (ΔG) significantly influences the erected state of a developer on the development rolls. As the drop-down amount (ΔG) increases, the repulsive magnetic force increases accordingly, causing dispersion of developer onto the photoconductive-body surface to become more severe so that the effect of development can be enhanced.

Figure 8:
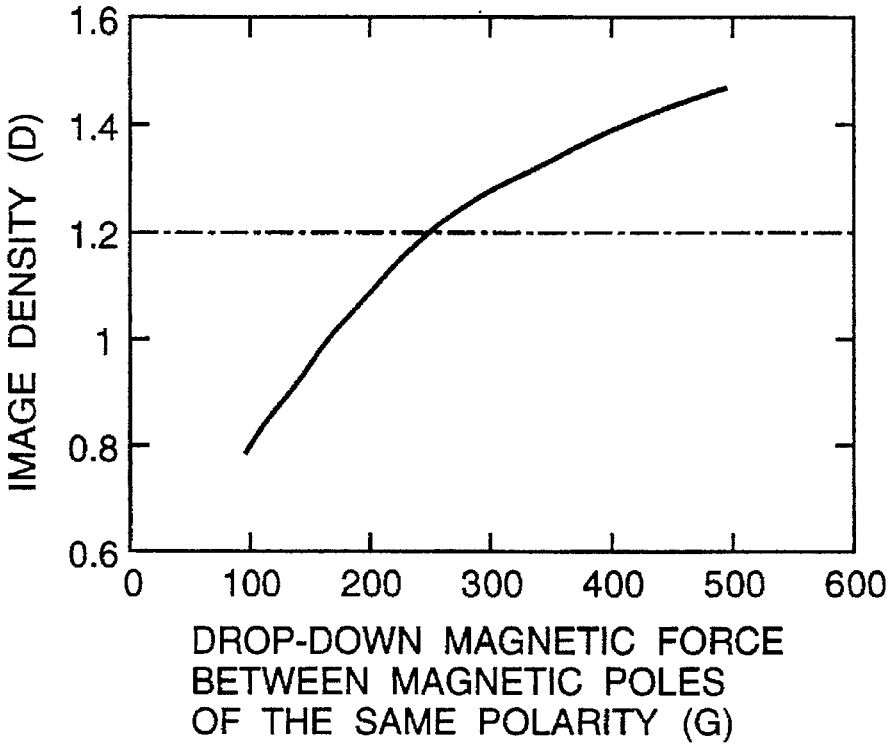
FIG. 8 is a diagram showing the relation of image density versus drop-down magnetic force between poles of the same polarity.

FIG. 8 shows the results of investigation regarding the relation of the drop-down amount (ΔG) between the same-polarity magnetic poles versus the resultant image density. It can be seen from viewing FIG. 8 that high image density can be attained when the drop-down amount (ΔG) falls within a range of 250 to 600 gausses (ΔG). As a consequence, excellent image quality can be achieved by arranging the drop-down amount (ΔG) between the same-polarity magnetic poles of the development poles of the second development roll group 8, 9 so as to range from 250 to 600 Gausses, preferably 300 to 600 Gausses. Additionally, it is recommendable that the peak value of the magnetic force of the same-polarity magnets be equivalent to or greater than 700 Gausses, preferably in the range from 900 to 1,300 Gausses, for maintaining the required development contact width to suppress the occurrence of adhesion of carriers onto the drum surface.

Figure 9:
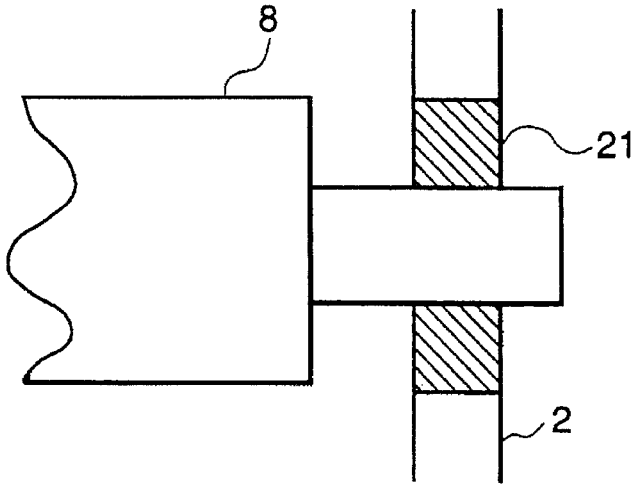
FIG. 9 is a diagram illustrating a development-roll shaft bearing section.
Figure 10:
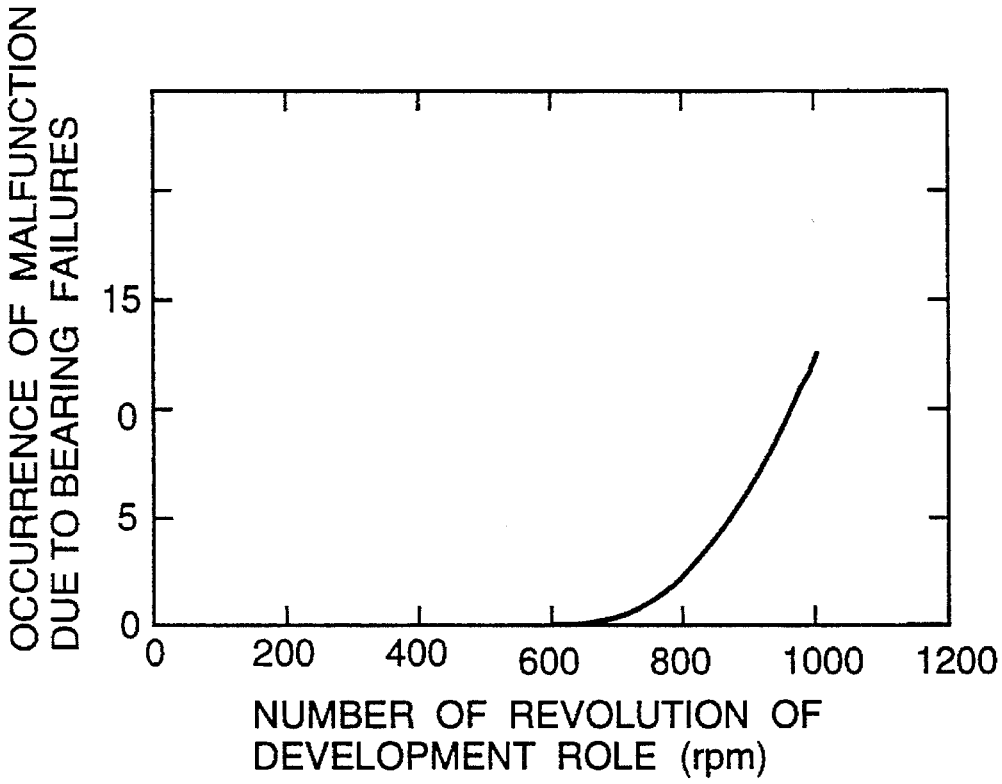
FIG. 10 is a diagram showing the relation between the rotation number of a development roll and fault occurrence number.

A still further embodiment of the invention will be described with reference to FIGS. 9 and 10. FIG. 9 illustrates a cross-section of one part of the embodiment wherein several development rolls, a development-carrying roll and a bearing are assembled together. The bearing designated by the numeral 21 is embedded in a development envelop wall 2 and in the surface of one side of a rotatable support member of the sleeve 7, for rotatably supporting the the first development roll 5, the second development roll group 8, 9 and the developer-carrying roll 4. As the first development roll 5, second development roll group 8, 9 increase in number of revolutions, the developer 3 (containing toner and carriers) tends to fly to the bearing 21 at an increased rate, and then enter the inside of the bearing 21. At this time, the heat release value will also be increased, causing the bearing to be shortened in life time. By taking into account of this, the relation of the number of rotations of development rolls of 50-mm diameter versus the bearing life time has been investigated, the results of which is shown in FIG. 10.

The occurrence of breaking failures is intended to mean that the actual number of rotational malfunction (starter torque increase, locking, etc) investigated through one year under an ordinary condition of usage. From viewing FIG. 10, it may be understood that, when rotation number of development is greater than 600 rpm or more, the resulting bearing life-time was extremely lowered. When the photoconductive body measures about 1,800 mm/s in rotation velocity, if the diameter of each roll of the second development roll group 8, 9 is 80 to 90 mm, then desired images of high density and of uniform quality can be obtained even under such a condition that the number of revolutions of each roll of the second development roll group 8, 9 is 600 rpm. Further, the bearings used for respective development rolls can also be enhanced in life time, whereby the reliability can thus be much improved. Note here that, as the development rolls and the developer-carrying roll increase in diameter, the resulting weight, cost and size will become greater accordingly; for this reason, it is preferable that the diameter is 50 to 90 mm for the development rolls, and 50 to 120 mm for the development carrying roll.

As has been described above, the present invention can provide a specific development apparatus which can reduce the load to the photoconductive body and the developer, and yet can offer images of high quality at higher reliability even when the printing is at high speed.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A development apparatus for performing a magnetic brush phenomenon by supplying a developer to an opposed photoconductive body with photoconductivity by use of a plurality of development rolls with magnetically attractive forces disposed near said photoconductive body, said apparatus comprising:

an upstream development roll having a unipole development magnet at a development pole contributing to development, and being movable in a direction opposite to a moving direction of said photoconductive body, wherein said movement directions are relative to a reference point between the photoconductive body and the upstream development roll;

a downstream development roll having a plurality of magnetically attractive nearby forces and causing a plurality of magnets of same polarity to be disposed near a development pole contributing to development;

wherein said upstream development roll is provided in an upstream of the moving direction of said photoconductive body;

wherein said downstream development roll is provided in a downstream of said moving direction of said photoconductive body; and wherein said upstream development roll and said photoconductive body define a peripheral speed ratio ranging from 0.5 to 1.5, while allowing said downstream development roll and said photoconductive body to define a peripheral speed ratio ranging from 0.6 to 0.95 and from 1.05 to 1.5.

2. The apparatus according to claim 1, wherein said photoconductive body moves a rate of 600 to 1800 mm per second.

3. The apparatus according to claim 1, wherein when a number of magnetic poles of the same polarity of the downstream development roll is even, an angle of a line connecting together a center line between said magnetic poles of the same polarity, a center of said photoconductive body and a center of the downstream development roll falls within a range of 2.5 to 10 degrees in an upstream direction, and wherein said number of said magnetic poles of the same polarity is odd, said angle falls within a range of 2.5 to 10 degrees in a downstream direction.

4. The apparatus according to claim 1, wherein a difference between a maximum value of magnetic force between said magnets of the same polarity of the upstream development roll and a decreased value between said magnets of the same polarity is in a range of 250 to 600 gausses.

5. The apparatus according to claim 1, wherein said upstream development roll and said downstream development roll rotate at 600 rpm or less, and wherein a diameter of each development roll is between about 50 mm and about 90 mm.

6. The apparatus according to claim 1, further comprising a carrier roll which rotates at 600 μm or less, and wherein a diameter of the carrier roll is between about 50 mm to about 120 mm.

7. The apparatus according to claim 1, further comprising a plurality of downstream development rolls having a plurality of magnetically attractive nearby forces and causing a plurality of magnets of same polarity to be disposed near a development pole contributing to development.

8. A development apparatus for performing a magnetic brush phenomenon by supplying a developer to an opposed photoconductive body with photoconductivity by use of a plurality of development rolls with magnetically attractive forces disposed near said photoconductive body, said apparatus comprising:

an upstream development roll having a unipole development magnet for a development pole contributing to development, and being movable in a direction opposite to a moving direction of said photoconductive body, wherein said movement directions are relative to a reference point between the photoconductive body and the upstream development roll;

a downstream development roll having a plurality of magnetically attractive nearby forces and causing a plurality of magnets of same polarity to be near at a development pole contributing to development;

wherein said upstream development roll is provided in an upstream of the moving direction of said photoconductive body; said downstream development roll is provided in a downstream of said moving direction of said photoconductive body; and wherein the downstream development roll in the downstream of a rotating direction of said photoconductive body and the upstream development roll in the upstream of the rotating direction of said photosensitive body satisfy a relation given as $$V_n \geqq V_{n+1}$$

where $V_n$ is a rotation speed of the downstream development roll, and $V_{n+1}$ is a rotation speed of the upstream development roll.

9. The apparatus according to any one of claims 1 or 8, wherein said developer contains a magnetic carrier made from spherical magnetite having a grain diameter of 80 to 130 μm and a toner with a grain diameter of 6 to 12 μm, and wherein said developer has a charge amount of 20 to 40 μC/g and a toner coverage ratio of 0.3 to 0.6%.

10. The apparatus according to claim 8, further comprising a plurality of downstream development rolls having a plurality of magnetically attractive nearby forces and causing a plurality of magnets of same polarity to be disposed near a development pole contributing to development.

11. A development apparatus for performing a magnetic brush phenomenon by supplying a developer to an opposed photoconductive body with photoconductivity by use of a plurality of development rolls with magnetically attractive forces disposed near said photoconductive body, said apparatus comprising:

an upstream development roll having a unipole development magnet at a development pole contributing to development, and being movable in a direction opposite to a moving direction of said photoconductive body, wherein said movement directions are relative to a reference point between the photoconductive body and the upstream development roll;

a group of downstream development rolls having a plurality of magnetically attractive nearby forces which cause a plurality of magnets of same polarity to be disposed near a development pole contributing to development, wherein when a number of magnetic poles of the same polarity of each development roll of said group of downstream development rolls is even, an angle of a line connecting together a center line between said magnetic poles of the same polarity, a center of said photoconductive body and a center of each development roll of said group of downstream development rolls falls within a range of 2.5 to 10 degrees in a clockwise direction relative to said group of downstream development rolls, and wherein said number of said magnetic poles of the same polarity is odd, said angle falls within a range of 2.5 to 10 degrees in a counter-clockwise direction relative to said group of downstream development rolls;

wherein said upstream development roll is provided in an upstream of the moving direction of said photoconductive body;

wherein said group of downstream development rolls is provided in a downstream of said moving direction of said photoconductive body; and wherein said upstream development roll and said photoconductive body define a peripheral speed ratio ranging from 0.5 to 1.5, while each of said group of downstream development rolls and said photoconductive body define a peripheral speed ratio ranging from 0.6 to 1.5.

12. The apparatus according to claim 11, wherein a difference between a maximum value of magnetic force between said magnets of the same polarity of said group of downstream development rolls and a decreased value between said magnets of the same polarity is in a range of 250 to 600 gausses.

13. The apparatus according to claim 11, wherein said upstream development roll and each development roll of said group of downstream development rolls rotate at 600 rpm or less, and wherein a diameter of each development roll is between about 50 mm and about 90 mm.

14. The apparatus according to claim 11, further comprising a carrier roll which rotates at 600 rpm or less, and wherein a diameter of the carrier roll is between about 50 mm and about 120 mm.

* * * * *